US006481076B2

(12) United States Patent
Zeng

(10) Patent No.: US 6,481,076 B2
(45) Date of Patent: Nov. 19, 2002

(54) RIVETING DIE APPARATUS INCORPORATING POSITIONING DEVICE

(75) Inventor: Fanfeng Zeng, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/746,652

(22) Filed: Dec. 22, 2000

(65) Prior Publication Data

US 2002/0059710 A1 May 23, 2002

(30) Foreign Application Priority Data

Nov. 17, 2000 (TW) ..... 089219988 U

(51) Int. Cl.[7] ..... B23P 11/00
(52) U.S. Cl. ..... 29/243.53
(58) Field of Search ..... 29/243.53, 283, 29/524.1, 251

(56) References Cited

U.S. PATENT DOCUMENTS 3,771,480 A * 11/1973 Johnson ..... 29/243.53
4,531,279 A * 7/1985 Gunter ..... 29/243.53

* cited by examiner

*Primary Examiner*—Robert C. Watson
(74) *Attorney, Agent, or Firm*—Wei Te Chung

(57) ABSTRACT

A riveting die apparatus includes an upper die (30) and a lower die (40). The upper die includes two punches (34) and a guide post (36). The lower die includes a lower mold plate (42). The lower mold plate defines two through apertures (60) corresponding to the punches, and two piston holes (58) in communication with the through apertures. Two blocks (44) are secured below the lower mold plate. Each block defines a blind hole (48) in communication with the corresponding piston hole. A spring (50) is accommodated in each combined piston hole and blind hole. A rod (52) is movably received in each through aperture and piston hole. A base (53) of each rod is accommodated in the piston hole, and abuts the corresponding spring. A guide bushing (54) is mounted on the lower mold plate. Workpieces placed on the lower mold plate are precisely positioned by the rods.

9 Claims, 2 Drawing Sheets

RIVETING DIE APPARATUS INCORPORATING POSITIONING DEVICE

BACKGROUND OF THE INVENTION

1. Field of the Invention

The present invention relates to a riveting die apparatus, and particularly to a riveting die apparatus with a positioning device.

2. Related Art

A conventional riveting die apparatus, as shown in FIG. 2, comprises an upper die 10 and a lower die 20. A guide post 11 depends from the upper die 10. A pair of punches 12 respectively depends from the upper die apparatus 10 on opposite sides of the guide post 11. Each punch 12 has a conical head 124. The punches 12 are shorter than the guide post 11. The lower die 20 comprises a lower mold plate 22, and a guide bushing 26. A pair of through holes 24 is defined in the plate 22, for respectively receiving the conical heads 124 of the punches 12.

In operation, a pair of stacked workpieces (not shown) is placed over one through hole 24. Holes (not shown) defined in the workpieces are aligned with the through hole 24. Similarly, another pair of similar stacked workpieces is placed over the other through hole 24 of the lower mold plate 22. The upper die 10 is moved downwardly. The guide post 11 is firstly received into the guide bushing 26, thereby guiding movement of the upper die 10. The conical heads 124 of the punches 12 then enter the holes of the workpieces. The conical heads 124 of the punches 12 then enter the through holes 24 of the lower mold plate 22. The two pairs of stacked workpieces on opposite sides of the lower mold plate 22 are thus respectively riveted together.

However, the die apparatus does not itself provide any means for correctly positioning the workpieces before the upper die 10 is moved downwardly. Workpieces are often not precisely positioned on the lower mold plate 22, particularly when the die apparatus operates continuously at high speed. Thus imperfect and damaged workpieces are frequently formed.

It is strongly desired to provide a die apparatus with a positioning device which overcomes the above problems encountered in the prior art.

SUMMARY OF THE INVENTION

Accordingly, an object of the present invention is to provide a riveting die apparatus with a positioning device which readily and precisely positions workpieces.

To achieve the above-mentioned object, a riveting die apparatus incorporating a positioning device in accordance with the present invention comprises an upper die and a lower die. The upper die comprises a pair of punches and a guide post between the punches. The lower die comprises a lower mold plate. The lower mold plate defines two through apertures corresponding to the punches, and two piston holes respectively in communication with the through apertures. Two blocks are secured below the lower mold plate. Each block defines a blind hole in communication with the corresponding piston hole of the lower mold plate. A spring is accommodated in each combined piston hole and blind hole. A rod is movably received in each through aperture. A base of each rod is accommodated in the piston hole, and abuts the corresponding spring. A guide bushing is mounted on the lower mold plate for guiding movement of the guide post. Workpieces placed on the lower mold plate are precisely positioned by the rods prior to operation of the die apparatus.

Other objects, advantages and novel features of the present invention will be drawn from the following detailed description of preferred embodiments of the present invention with reference to the attached drawings, in which:

DESCRIPTION OF THE PREFERRED EMBODIMENTS

Figure 1:
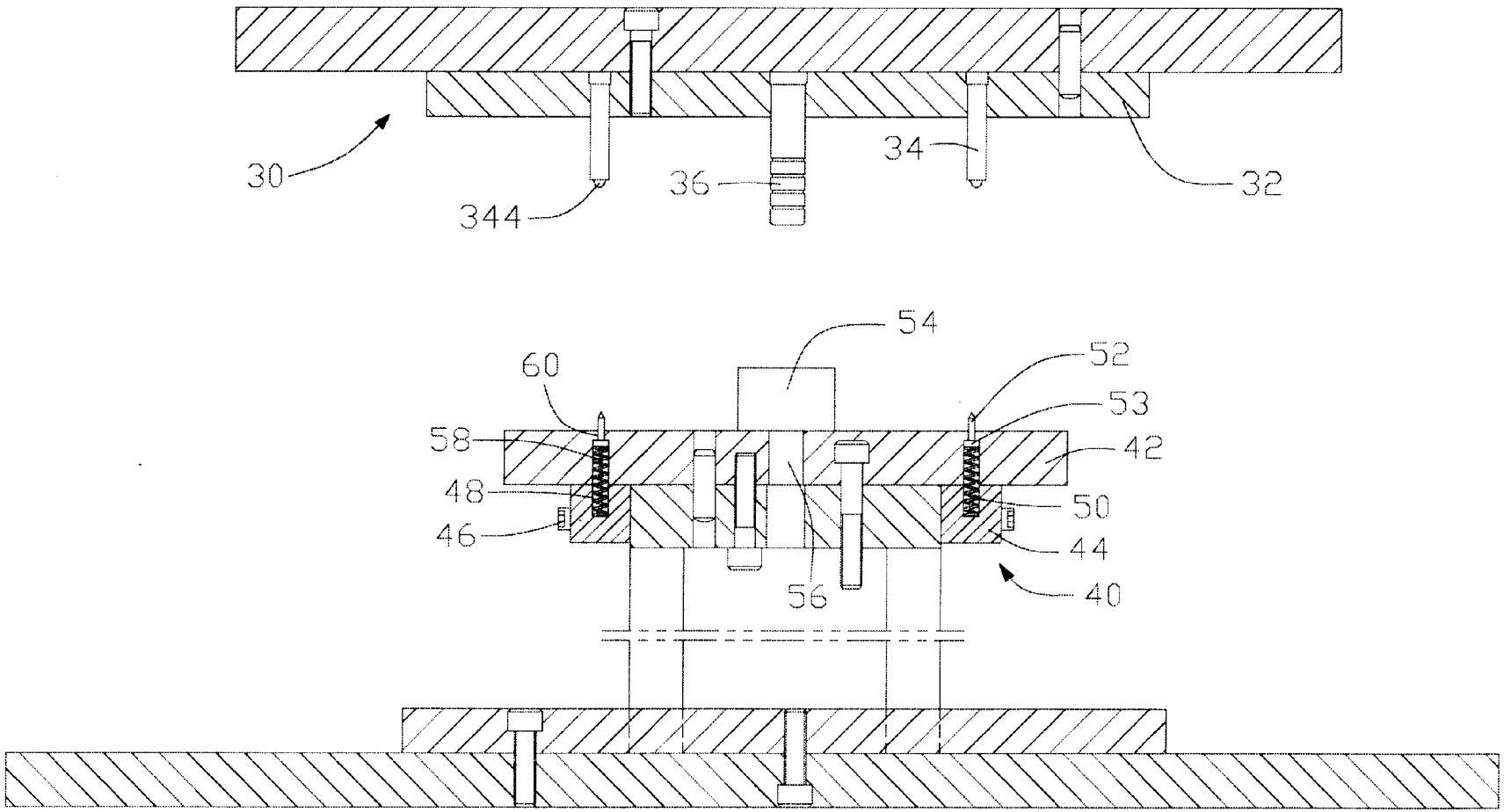
FIG. 1 is a schematic cross-sectional side view of a riveting die apparatus in accordance with a preferred embodiment of the present invention.
Figure 2:
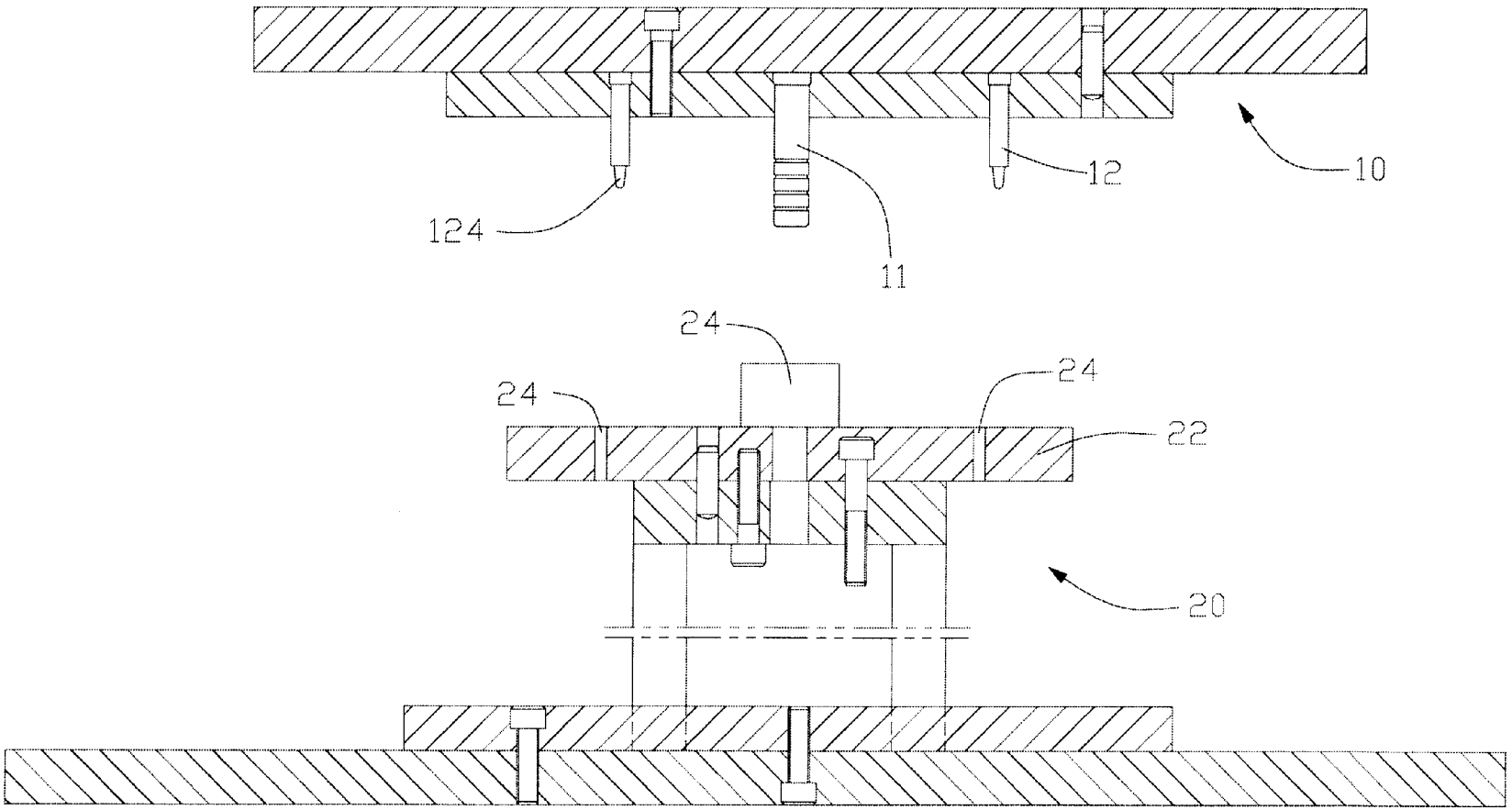
FIG. 2 (PRIOR ART)
FIG. 2 is a schematic cross-sectional side view of a conventional riveting die apparatus.

Referring to FIG. 1, a riveting die apparatus in accordance with a preferred embodiment of the present invention comprises an upper die 30 and a lower die 40.

The upper die 30 comprises an upper mold plate 32. A pair of punches 34 is fixed in the upper mold plate 32, and depends therefrom Each punch 34 has a conical head 344. A guide post 36 depends from the upper mold plate 32 between the punches 34.

The lower die 40 comprises a lower mold plate 42. A pair of through apertures 60 is defined in the lower mold plate 42, corresponding to the punches 34 of the upper die 30. A pair of piston holes 58 is defined in the lower mold plate 42 below and in communication with respective through apertures 60. A pair of blocks 44 is secured under respective opposite sides of the lower mold plate 42 by a pair of bolts 46 respectively. Each block 44 defines a blind hole 48 therein, in communication with the corresponding piston hole 58 of the lower mold plate 42. Each mutual piston hole 58 and blind hole 48 together form a retaining hole (not labeled). A pair of springs 50 is accommodated in the respective retaining holes (not labeled). A pair of rods 52 is respectively movably received in the through apertures 60 of the lower mold plate 42. Each rod 52 has a base 53 at a bottom thereof. The bases 53 are accommodated in top portions of the respective retaining holes (not labeled), and abut respective springs 50. A guide bushing 54 is mounted on a top of the lower mold plate 42, for guiding movement of the guide post 36 of the upper die 30. A guide hole 56 is defined in the lower mold plate 42 below the guide bushing 54, for extension of the guide post 36 therein.

In operation, a pair of stacked workpieces (not shown) is placed on the top of the lower mold plate 42, above a corresponding through aperture 60. Similarly, another pair of stacked workpieces (not shown) is placed on the top of the lower mold plate 42, above the other corresponding through aperture 60. The rods 52 are respectively received in positioning holes (not shown) of the stacked workpieces, thereby securely positioning the stacked workpieces. The upper die 30 is moved downwardly. The guide post 36 is firstly received into the guide bushing 54 thereby guiding movement of the upper die 30. The punches 34 of the upper die 30 then enter the positioning holes of the workpieces and push the rods 52 downwardly. The upper die 30 is continued to be moved downwardly until the conical heads 344 of the punches 34 enter the respective through apertures 60 of the lower mold plate 42. Thus the stacked workpieces on respective opposite sides of the lower mold plate are respectively riveted together. The springs 50 are compressed by the downward movement of the rods 52. When the upper die 30 is moved back upwardly, the springs 50 expand back to their original positions. The springs 50 push the rods 52 back upwardly to their original positions.

An alternative embodiment of the present invention comprises two pairs of punches 34 respectively depending from opposite sides of the upper mold plate 32. Accordingly, two pairs of corresponding components are also employed. Such corresponding components include the blocks 44, the bolts 46, the through apertures 60, the piston holes 58, the blind holes 48, the rods 52, the bases 53, and the springs 50.

In the present invention, the stacked workpieces are accurately and fixedly pre-positioned by the rods 52 of the lower die 40 before the upper die 30 is moved downwardly. Thus the workpieces are precisely riveted together by the riveting die apparatus.

It is understood that the present invention may be embodied in other forms without departing from the spirit thereof. Thus, the present example and embodiments are to be considered in all respects as illustrative and not restrictive, and the present invention is not to be limited to the details given herein.

What is claimed is:

1. A riveting die apparatus comprising:

an upper die with at least one punch depending therefrom; and a lower die with a lower mold plate, the lower plate defining at least one through aperture corresponding to the at least one punch and at least one piston hole communication with the at least one through aperture, at least one elastic member being accommodated in the at least one piston hole, at least one rod being movably received in the at least one through aperture and the at least one piston hole with a lower end thereof abutting the corresponding elastic member, wherein the upper die further comprises a guide post, and the lower die apparatus has a guide bushing for guiding the movement of the guide post and a guide hole for extension of the guide post.

2. The riveting die apparatus as claimed in claim 1, wherein the lower die further comprises at least one block secured under the lower mold plate for supporting the elastic member.

3. The riveting die apparatus as claimed in claim 2, wherein the at least one block defines a blind hole in communication with the corresponding at least one piston hole of the lower mold plate, and the at least one elastic member is accommodated in the at least one piston hole and the blind hole.

4. The riveting die apparatus as claimed in claim 1, wherein each elastic member is a spring.

5. The riveting die apparatus as claimed in claim 1, wherein the at least one rod is projectable from a top surface of the lower mold plate.

6. A riveting die apparatus comprising:

an upper die with at least one punch depending therefrom; and a lower die with a lower mold plate, the lower plate defining at least one through aperture corresponding to the at least one punch and at least one piston hole communication with the at least one through aperture, at least one elastic member being accommodated in the at least one piston hole, at least one rod being movably received in the at least one through aperture and the at least one piston hole with a lower end thereof abutting the corresponding elastic member, wherein the lower die further comprises at least one block securing under the lower mold plate thereof.

7. The die apparatus as claimed in claim 6, wherein the at least one block defines a blind hole in communication with the piston hole of the lower mold plate, and the elastic member is accommodated in the piston hole and the blind hole.

8. A riveting die apparatus comprising:

an upper die with a punch depending therefrom; and a lower die with a lower mold plate on a top portion thereof, the lower plate defining a through aperture in alignment with the punch and a piston hole in alignment and communication with the through aperture, an elastic member being accommodated in the piston hole, and a rod being movably received in said through aperture and said piston hole with thereof a top end upwardly extending out of said aperture and above a top surface of said lower mold plate for receipt within a positioning hole in a workpiece.

9. The apparatus as claimed in claim 8, wherein said punch includes a conical head adapted to be received in the through aperture.

* * * * *